United States Patent [19]

Cordova et al.

[11] Patent Number: 4,688,309

[45] Date of Patent: Aug. 25, 1987

[54] POLISHING METHOD AND APPARATUS

[75] Inventors: David S. Cordova, Midlothian; Rob R. Gordon, Jr., Chesterfield, both of Va.

[73] Assignee: Allied Corporation, Morris Township, Morris County, N.J.

[21] Appl. No.: 816,083

[22] Filed: Jan. 3, 1986

[51] Int. Cl.[4] ..... B24B 1/00; B24B 29/00

[52] U.S. Cl. ..... 29/90 R; 15/159 A; 51/400; 264/161; 264/162; 425/806

[58] Field of Search ..... 29/33 A, 81 R, 81 H; 264/161, 162, 232, 340; 425/806; 15/159 A, 208, 209 R, 209 C, 209 B; 51/400, 401

[56] References Cited

U.S. PATENT DOCUMENTS

| | | | |
|---|---|---|---|
| 3,238,553 | 3/1966 | Bailey et al. | 15/159 A |
| 3,312,994 | 4/1967 | Fassio | 15/159 A |
| 3,327,339 | 6/1967 | Lemelson | 15/159 A |
| 4,015,306 | 4/1977 | Fenster | 15/227 |
| 4,042,995 | 8/1977 | Varon | 15/159 A |
| 4,355,067 | 10/1982 | Neveu | 15/209 R |
| 4,413,110 | 11/1983 | Kavesh et al. | 264/210.8 |

*Primary Examiner*—Nicholas P. Godici
*Assistant Examiner*—Jerry Kearns

[57] ABSTRACT

Method and apparatus for polishing an article are provided. The method features the step of contacting the article in an area to be polished with at least one polyethylene filament. The polishing apparatus comprises at least one polyethylene filament, and means for rotating the filament about a central axis for contact with the surface to be polished. The polyethylene filament of choice is characterized by a tenacity and an elongation such that the product of the tenacity and the square root of the elongation (toughness paramenter) ranges from 20 to 60 units. With use of such a filament, deflashing of an article to be deflashed can be accomplished simultaneously with the polishing of the article.

25 Claims, 3 Drawing Figures

POLISHING METHOD AND APPARATUS

BACKGROUND OF THE INVENTION

Field of The Invention

This invention relates to a method and apparatus for polishing an article. More particularly, this invention relates to the use of polyethylene filament to polish articles, preferably of molded plastic reinforced with staple fiber blends, which also need to be deflashed/-deburred.

The Prior Art

The removal of the thin ridge or area of roughness produced in cutting or shaping metal is known as deburring. Deburring has been accomplished in many ways, e.g. with vibratory tumblers, flap wheels and abrasive-bristle brushes. With the latter, new grit or cutting edges are continuously exposed to provide a clean tool with long life.

When articles are molded from thermosets, thermoplastics, rubber and the like, the initial product often has extra material called "flash" attached along the mold parting line. Flash results from that portion of the charge which flows from or is extruded from the mold cavity during molding, and is undesirable on most final products. The removal of flash, or "deflashing", has been accomplished in many ways, e.g., deflashing manually with razor blades, rotating or shaking with abrasive media to break off the flash, and deflashing cryogenically.

Deflashing has been complicated by the inclusion of some types of reinforcing staple fiber in compounds to be molded. Many compression molded plastic parts reinforced with nylon or polyester staple fibers (as well as with fiber glass) have a very heavy, excess flashing which cannot be removed by automatic deflashing machines due to a tendency of the flash to adhere to the reinforcing polyester fiber. This problem does not exist with 100 percent fiber glass reinforced plastic parts, since the fiber glass is easily broken off with a crude tool, such as a piece of wood rubbed against the flashing.

Research was directed towards the deflashing of an injection molded part reinforced with a fiber glass and polyethylene terephthalate staple fiber blend. Incidental thereto was the discovery of the polishing effect of the polyethylene filament. The filaments and prdduction thereof may be found in U.S. Pat. No. 4,413,110 to Kavesh et al, U.S Pat No. 4,430,383 to Smith et al., U.S. Pat. No. 4,344,908 to Smith et al., U.S. Pat. No. 4,356,138 to Kavesh et al., U.S. Pat. No. 4,403,012 to Harpell et al., U.S. Pat. No. 4,422,993 to Smith et al., U.S. Pat. No. 4,436,689 to Smith et al., U.S. Pat. No. 4,137,394 to Meihuizen et al., all of which are hereby incorporated by reference.

SUMMARY OF THE INVENTION

The present invention provides a method and apparatus for polishing an article. Metal, wood and plastic articles are contemplated. The preferred metal articles are cast or machined while the preferred plastic articles are molded. Exemplary of suitable molding systems for plastics are compression and injection molding systems, the latter being preferred.

The definition of flash is deemed to also encompass burrs/splinters in the accompanying description and claims. By filament is meant a monofilament or multifilament end or ends as well as a sheet; the ends may be braided or twisted in some other conventional fashion if desired. The cloth of the present invention may be woven, nonwoven, knitted, or combinations thereof as desired.

The present invention includes a method of polishing an article, comprising the step of contacting the article in an area to be polished with a polyethylene filament. Suitable fibers are those having a weight average molecular weight of at least about 300,000, preferably at least about 1,000,000 and more preferably between about 2,000,000 and about 9,000,000. Yarn intrinsic viscosity is measured in decalin at 135° C. Molecular weight is then determined according to ASTM 01601-59T and D4020 using that IV. These test methods are hereby incorporated by reference. The fibers may be grown in solution spinning processes such as described in U.S. Pat. No. 4,137,394 to Meihuzen et al. or U.S. Pat. No. 4,356,138 to Kavesh et al., or a fiber spun from a solution to form a gel structure, as described in German Off. No. 3004699 and GB No. 2051667, and especially as described in U.S. Pat. No. 4,413,110 to Kavesh et al., all of which are hereby incorporated by reference.

The polyethylene filament used in the present invention is characterized by a tenacity and an elongation (at break) such that the product of the tenacity and the square root of the elongation, known as the toughness parameter, ranges from 20 to 60 units, more preferably from 25 to 56 units, most preferable 55–56 units. The tenacity of the fibers should be about 10 to 50 grams per denier (gpd), more preferably 15 to 45 grams per denier, and most preferably 30 to 35 grams per denier. The elongation at break, in percent, ranges from about 2.5 to 5.0%, more preferably from 2.6% to 3.5%. Both tenacity (gpd) and elongation at break (%) are determined in accordance with ASTM D2256, as is tensile (initial) modulus (gpd) which ranges from 1,000 to 3,000 grams per denier, preferably 1,200 to 2,500 grams per denier, and most preferably from 1,400 to 2,000 grams per denier.

The preferred method of contacting the article in the area to be polished comprises striking the article in that area with a first filament of polyethylene, followed by striking the article in the same area with succeeding filaments of polyethylene until the area is shiny. In one embodiment, the article further has a flash in the area to be shined, and the striking steps simultaneously result in deflashing the article.

The polishing apparatus of the present invention comprises at least one filament of polyethylene as described above. The polyethylene filament or filaments may form part of a cloth which has other types of fibers too or may comprise some or all of the bristles of a polishing brush. The polishing apparatus preferably comprises at least one polyethylene filament and means for rotating that filament about a central axis for contact with a surface to be polished. Again, the polyethylene filament is as characterized above.

When the article to be polished is plastic, the resin matrix may include thermosetting or thermoplastic (including polyolefin) resins. Suitable thermosetting resins include polyester (preferably unsaturated), epoxy, polyurethane or vinyl ester resin system. Suitable thermoplastic resin systems include polyvinyl chloride, polyethylene, polypropylene, polystyrene, polyvinyl alcohol, polyamide, polyurethane, etc. The resin matrix also may include enhancers, mold release agents and fillers, as are known in the composite art, in addition to the resin and reinforcing fibers.

When the plastic article is to be deflashed simultaneous with shinning, it may also be at least partially fiber reinforced, the preferred reinforcing fibers being hybrid blends of polyester or polyamide with fiberglass.

The preferred reinforcing polyesters are the linear terephthalic polyesters, i.e. polyesters of a glycol containing from 2 to 20 carbon atoms and a dicarboxylic acid component containing at least about 75 percent terephthalic acid. The remainder, if any, of the dicarboxylic acid component may be any suitable dicarboxylic acid such as sebacic acid, adipic acid, 0 isophthalic acid, sulfonyl-4,4'-dibenzoic acid, 2,8-dibenzofurandicarboxylic acid, or 2,6-naphthalene dicarboxylic acid. The glycols may contain more than two carbon atoms in the chain, e.g., diethylene glycol, butylene glycol, decamethylene glycol, and bis(1,4-hydroxymethyl)cyclohexane. Examples of linear terephthalate polyesters which may be employed include poly(ethylene terephthalate), poly(ethylene terephthalate/5-chloroisophthalate)(85/15), poly(ethylene terephthalate/5-[sodium sulfo]-isophthalate)(97/3), poly(cyclohexane-1,4-dimethylene terephthalate), and poly(cylohexane-1,4-dimethylene terephthalate/hexahydroterephthalate)(75/25). The preferred polyesters are commercially available from Allied Corporation as COMPET TM 1W71-HI, 1W71-LO, 1W69-HI and 1W69-LO.

Suitable reinforcing polyamides include, for example, those prepared by condensation of hexamethylene diamine and adipic acid, condensation of hexamethylene diamine and sebacic acid known as nylon 6,6 and nylon 6,10, respectively, condensation of bis(para-aminocyclohexyl)-methane and dodecanedioic acid, or by polymerization of 6-caprolactam, 7-aminoheptanoic acid, 8-caprolactam, 9-aminopelargonic acid, 11-aminoundecanoic acid, and 12-dodecalactam, known as nylon 6, nylon 7, nylon 8, nylon 9, nylon 11 and nylon 12, respectively. Other suitable reinforcing polyamides include the aramids, e.g., Kevlar ®. The most preferred polyamide is nylon 6 commercially available from Allied Corporation as COMPET TM IR69-HI and IR69-LO.

The following tests are used in this application. Denier is calculated as follows: a 9-meter length skein under 300±100 gram tension is weighed on a balance to three decimal places; the weight obtained is multiplied by 1,000 to arrive at the reported denier. Tenacity, elongation at break and initial modulus are found pursuant to ASTM D2256 option 1A, and material specifications require crosshead speed to be 10 inches (25 cm) per minute with a gauge length of 10 inches (25 cm). Density in a gradient tube (specific gravity) is determined in accordance with ASTM D1505. Melt point is determined using a Perkin-Elmer DSC (differential scanning calorimeter) 2-C. An 0.5–1.0 mg sample of yarn is cut up into approximately 3 mm lengths and encapsulated with a drop of silicon oil in an aluminum sample pan. The sample is run on the DSC at a scanning rate of 10° C. per minute from room temperature (about 30° C.) to 170° C. to find the main melting point peak. Melt point is alternatively determined using a Mettler Hot Stage Melting Apparatus, manufactured by Mettler. The filament size, in microns, is the equivalent diameter, arrived at by measuring single filament denier with a vibroscope according to ASTM D1577; the equivalent diameter is calculated as follows:

$$\text{Equivalent Diameter (microns)} = \sqrt{\frac{\text{Denier}}{(\text{Density})\,(7.0686)\,(10^{-3})}}$$

It should be noted that the equivalent diameter is given in the case of polyethylene filament since the filaments are not truly round. To determine shrinkage at boil, mark 1 meter ($L_1$) on a suspended length of yarn having an 0.05 gpd weight thereon; boil the yarn for 30 minutes and then let dry; remeasure the marked length ($L_2$) with the same weight suspended therefrom; and the shrinkage (%) will be $$\frac{L_1 - L_2}{L_1}(100)$$

DESCRIPTION OF THE PREFERRED EMBODIMENT

Preliminary research was directed towards the deflashing of a black injection molded polyester BMC (bulk molding compound) part reinforced with a fiberglass and polyethylene terephthalate (1W71-LO, commercially available from Allied Corporation) staple fiber blend.

Figure 1:
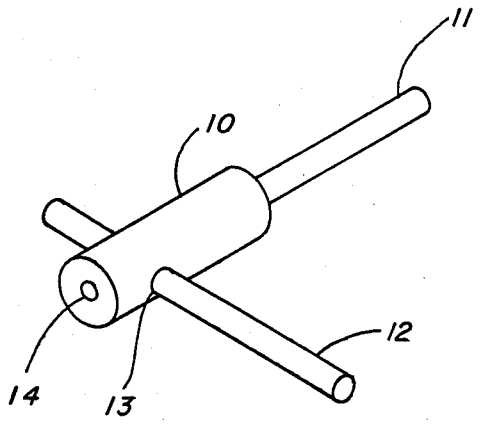
FIG.1 is a view of the polishing apparatus of the present invention.

With reference to FIG.1, a mandril 10 with a shank 11 at one end was inserted into a collet which was an integral part of an air spindle (A-6K-61, 60,000 rpm grinder, D-M-E Company, a Fairchild Industries Company), unshown. A nut (unshown) was run up on the collet to secure the mandril 10 shank 11. Fiber 12 was placed in mandril 10 through passageway 13 and was held in place with a set screw at 14. Shank 11 had a diameter of 0.13 inch (0.32 cm) and a length of 0.50 inch (1.3 cm). Mandril 10 had a diameter of 0.25 inch (0.64 cm) and a length of 0.38 inch (0.95 cm). Fiber 12 had a diameter of about 0.079 inch (0.199 cm) and projected out from mandril 10 about 3.0 inches (7.6 cm) on one side.

The fiber utilized was a 16-carrier braid with no core of polyethylene fiber, commercially available from Allied Corporation as SPECTRA TM 900, characterized as follows: yarn IV 19.0–19.1, molecular weight about 3,000,000, 1,200 denier/118 filaments per end, tenacity of 30 gpd, elongation at break of 3.5%, tensile (initial) modulus of 1,400 gpd, a shrinkage at boil of less than 1%, a density in gradient tube of 0.97 grams per cubic cm at 23° C., a melt point in ° C of about 137° -139° (147° Mettler) and a filament size (equivalent diameter) in microns of 38. The toughness parameter was about 55. The braid was coated (wet pickup of about 3%–6%) with a binder system to make it stiffer for threading mandril 10. The binder system was a salt, preferably ammonium and sodium in a 50/50 ratio, solution of the condensation polymer consisting essentially of: diethylene glycol (45–55 moles), isophthalic acid (15–25 moles), terephthalic acid (15–25 moles) and trimetallitic anhydride (5–10 moles). The binder system served only as a stiffener, and was stripped off of the braid almost immediately. Other coatings/binder systems may similarly be used.

When power was applied, air came up through the air 20 spindle in a conventional manner to rotate the spindle, of which the collet is an integral part, and thus mandril 10. Centrifugal force caused fiber 12 to stand out from mandril 10. Rotating fiber 12 was brought into contact with the flash of an injection molded part [an electrical sander injection molded of polyester resin, calcium carbonate, glass, black pigment, mold release agent, and 1W71-LO polyester reinforced fibers of staple length 0.25 inch (0.63 cm)], which was at ambient temperature. The flash was readily removed, and it was noticed that the deflashed part surprisingly had an extraordinary sheen. It is believed that an equally acceptable filament can be formed from SPECTRA TM 1000 fiber, commercialy available from Allied Corporation, and characterized as follows: toughness parameter of 56; 650 denier/120 filaments per end; tenacity of 35 gpd; elongation at break of 3.5%; tensile (initial) modulus of 2,000 gpd; yarn IV, molecular weight, shrinkage, density in gradient tube and melt point the same as for the SPECTRA TM 900 fiber described above; and filament size (equivalent diameter) in microns of 27.

A nylon monofilament (commercially available from Sears Roebuck) of diameter 0.065 inch (0.165 cm) was substituted for the polyethylene filament. The nylon monofilament broke close to the mandril 10 passageway after about one minute of deflashing, with the monofilament being brought into increasingly greater contact along its length with the flash. This occurred repeatedly. The deflashed area of the part also failed to exhibit the extraordinary sheen resulting from use of the polyethylene filament above.

A polyester multifilament yarn (COMPET TM 1W71-LO, commercially available from Allied Corporation) of diameter 23 microns and approximately 11,000 denier was substituted for the polyethylene filament. The fiber broke close to the mandril 10 passageway after about one minute of deflashing, with the monofilament being brought into increasingly greater contact along its length with the flash. This also occurred repeatedly. The deflashed area of the part similarly failed to exhibit the extraordinary sheen obtained through use of the polyethylene filament above.

Figure 2:
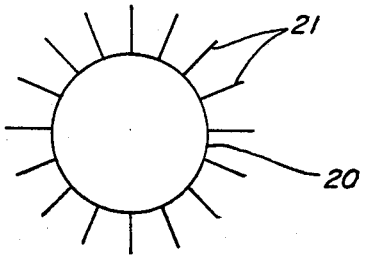
FIG.2 is a cross-section of a polishing brush 20 of the present invention.

FIG.2 depicts brush 20 with filaments (or bristles) 21, all or some of which may be formed of the polyethylene filament previously described. It is anticipated that such a brush may be used to polish the surface of articles as previously described.

Figure 3:
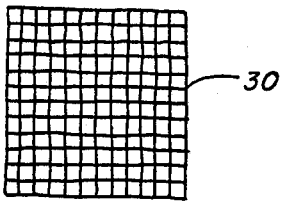
FIG.3 is a plan view of cloth 30 of the present invention.

It is anticipated that fabric or cloths 30 (See FIG.3) made of the polyethylene filament described above in whole or in part, should also be acceptable polishing devices, and that plastic parts without fibrous reinforcement, metal articles and wooden articles may be polished using this invention as well.

We claim:

1. A method of polishing an article, comprising the step of contacting said article in an area to be polished with a polyethylene filament characterized by a tenacity of 10 to 50 gpd and an elongation of 2.5 to 5.0 percent such that the product of the tenacity and the square root of the elongation ranges from 20 to 60 units.

2. The method of claim 1 wherein said article is contacted with a polishing cloth comprising said polyethylene filament.

3. The method of claim 2 wherein said polyethylene filament minimally has a molecular weight of at least 300,000.

4. The method of claim 3 wherein said polyethylene filament has a molecular weight of at least 1,000,000.

5. The method of claim 1 wherein said polyethylene filament is further characterized by a tensile modulus of 1,000 to 3,000 gpd.

6. The method of claim 1 wherein said product ranges from 25 to 56 units.

7. The method of claim 6 wherein said polyethylene filament is characterized by a tenacity of 15 to 45 gpd and an elongation of 2.6 to 3.5%.

8. The method of claim 7 wherein said polyethylene filament is further characterized by a tensile modulus of 1,200 to 2,500 gpd.

9. The method of claim 1 wherein said polyethylene filament has a molecular weight of at least 1,000,000.

10. The method of claim 1 wherein said contacting step comprises striking the article in said area to be polished with a first filament of polyethylene, followed by striking the article in said area with succeeding filaments of polyethylene until said area is shiny.

11. The method of claim 10 wherein said article further has a flash in said area and wherein said striking steps simultaneously result in deflashing said article.

12. The method of claim 11 wherein said filament has a molecular weight of at least 300,000.

13. The method of claim 12 wherein said polyethylene filament has a molecular weight of at least 1,000,000.

14. The method of claim 13 wherein said polyethylene filament is further characterized by a tensile modulus of 1,000 to 3,000 gpd.

15. The method of claim 11 wherein said product ranges from 25 to 56 units.

16. The method of claim 15 wherein said polyethylene filament is characterized by a tenacity of 15 to 45 gpd and an elongation of 2.6 to 3.5%.

17. The method of claim 16 wherein said polyethylene filament is further characterized by a tensile modulus of 1,200 to 2,500 gpd.

18. The method of claim 17 wherein said polyethylene filament has a molecular weight of at least 1,000,000.

19. The method of claim 18 wherein said article comprises a plastic reinforced with fibers selected from the group consisting of polyester, polyamide, glass, and blends thereof.

20. The method of claim 19 wherein said article comprises a polyester resin matrix reinforced with a blend of polyester and fiber glass staple.

21. Polishing apparatus comprising:

a. at least one polyethylene filament characterized by a tenacity of 10 to 50 gpd and an elongation of 2.5 to 60 units; and b. means for rotating said filament about a central axis for contact with a surface to be polished.

22. The polishing apparatus of claim 21 wherein said polyethylene filament is further characterized by a tensile modulus of 1,000 to 3,000 gpd.

23. The polishing apparatus of claim 21 wherein said polyethylene filament has a molecular weight of at least 1,000,000.

24. The polishing apparatus of claim 23 wherein said polyethylene filament is characterized by a tenacity of 15 to 45 gpd and an elongation of 2.6% to 3.55 .%

25. The polishing apparatus of claim 24 wherein said polyethylene filament is further characterized by a tensile modulus of 1,200 to 2,500 gpd.

* * * * *

UNITED STATES PATENT AND TRADEMARK OFFICE

CERTIFICATE OF CORRECTION

PATENT NO. : 4,688,309

DATED : August 25, 1987

INVENTOR(S) : David S. Cordova and Rob R. Gordon, Jr.

It is certified that error appears in the above-identified patent and that said Letters Patent is hereby corrected as shown below:

Col. 6, line 53, following 2.5, add --to 5.0 percent such that the product of the tenacity and the square root of the elongation ranges from 20--

Col. 6, line 64 "3.55%" should read --3.5%--

Signed and Sealed this

Fifth Day of January, 1988

*Attest:*

*Attesting Officer*

DONALD J. QUIGG

*Commissioner of Patents and Trademarks*